US008556378B2

(12) United States Patent
Hutchison

(10) Patent No.: US 8,556,378 B2
(45) Date of Patent: Oct. 15, 2013

(54) MAINTENANCE STATION FOR AN IMAGING APPARATUS

(75) Inventor: Gregory Leon Hutchison, Shelbyville, KY (US)

(73) Assignee: Funai Electric Co., Ltd. (JP)

( * ) Notice: Subject to any disclaimer, the term of this patent is extended or adjusted under 35 U.S.C. 154(b) by 0 days.

(21) Appl. No.: 13/399,059

(22) Filed: Feb. 17, 2012

(65) Prior Publication Data

US 2013/0215191 A1 Aug. 22, 2013

(51) Int. Cl.
*B41J 2/165* (2006.01)

(52) U.S. Cl.
USPC ..... 347/33

(58) Field of Classification Search
USPC ..... 347/33, 32, 22
See application file for complete search history.

(56) References Cited

U.S. PATENT DOCUMENTS

| | | | | | |
|---|---|---|---|---|---|
| 5,257,044 | A * | 10/1993 | Carlotta et al. | ..... | 347/32 |
| 5,440,331 | A * | 8/1995 | Grange | ..... | 347/32 |
| 5,455,609 | A * | 10/1995 | Gast et al. | ..... | 347/32 |
| 5,563,637 | A * | 10/1996 | Francis et al. | ..... | 347/32 |
| 7,748,823 | B2 * | 7/2010 | Hung | ..... | 347/33 |
| 2002/0126178 | A1 | 9/2002 | Toh | | |
| 2005/0195240 | A1 | 9/2005 | Hiraki | | |

* cited by examiner

*Primary Examiner* — Matthew Luu
*Assistant Examiner* — Michael Konczal
(74) *Attorney, Agent, or Firm* — Amster, Rothstein & Ebenstein LLP

(57) ABSTRACT

A maintenance station for servicing a printhead mounted on a carrier includes mechanisms that separate a wiping function from a capping function. The maintenance station includes a housing mounting a maintenance sled that is movable between a wiping position and a capping position. The capping position follows the wiping position along a direction of travel by the carrier when it enters the maintenance station. As the carrier enters the maintenance station, a latch pivotably mounted to the maintenance sled selectively locks the maintenance sled in the wiping position without engaging the capping position based on a stop position of the carrier upon initial entrance into the maintenance area.

16 Claims, 6 Drawing Sheets

MAINTENANCE STATION FOR AN IMAGING APPARATUS

FIELD OF THE INVENTION

The present invention relates to micro-fluid applications, such as inkjet printing. More particularly, it relates to a maintenance or service station in an inkjet printer employing asynchronous wiping mechanisms.

BACKGROUND

The art of printing images with micro-fluid technology is relatively well known. Inkjet printing devices utilize consumable inkjet cartridges or ink tanks in fluid communication with a permanent or semi-permanent ejection head, also known as printhead, to record text and images on a print media. The printhead typically moves on a carriage relative to the media path and a control system activates the printhead to selectively eject ink droplets onto the print media in a pattern of pixels corresponding to images being printed.

Various inkjet printing systems utilize a maintenance or service station which includes a wiper mechanism for wiping away particles accumulated on the printhead, and a receptacle into which the printhead periodically fires to purge dried or plugged nozzles. The receptacle collects ink droplets sprayed from the printhead during the clearing process. The service station may also include a mechanism to cap the printhead nozzles when the printer is not printing. Typically, the cap mechanism encloses the exposed outer surface of the printhead defining the nozzle array to help prevent drying of the ink at the nozzles, and prevent contamination with dust.

In some designs, the wiping action is typically "east-west" wherein the printhead is wiped by a wiper in an east-west motion transverse the media feed direction. East-west maintenance typically utilizes the existing motion of a print carriage within an inkjet printer to perform maintenance on the printhead. In other designs, the printhead heater chips require that the orientation of printhead wiping occur in a "north-south" direction perpendicular to the carriage or printhead operating motion. In both systems, the wiper may remain stationary while the printhead is moved back and forth against the wiper for wiping, or vice versa. East-west maintenance, however, is more commonly used because it is typically simpler to implement as it does not require additional drive mechanisms to operate the maintenance system. For example, the same drive mechanism controlling the movement of the carriage can be used to move the printhead back and forth against a stationary wiper.

Normally, wiping is synchronous with a capping function in an east-west maintenance system in that wiping is performed after every capping function. However, excessive printhead wiping associated with the capping function may gradually impair the printhead and shorten its life. In turn, print quality may suffer.

As print quality is an important parameter for imaging performance, a need exists in the art to improve printhead maintenance. Further needs may contemplate a system which separates the wiping function from the capping function. Additional benefits and alternatives are also sought when devising solutions.

SUMMARY

The above-mentioned and other problems become solved by separating a wiping function from a capping function. A maintenance station for servicing a printhead mounted on a carrier includes a maintenance housing defining a maintenance area. The maintenance housing mounts a maintenance sled that is movable between a wiping position and a capping position. The capping position follows the wiping position along a direction of travel by the carrier when it enters the maintenance area. As the carrier enters the maintenance area, features selectively lock the maintenance sled in the wiping position without engaging the capping position based on a stop position of the carrier.

In an example embodiment, the maintenance sled includes an arm pivotably mounted to the maintenance sled. The arm includes a latch member that locks the maintenance sled in the wiping position when the carrier initially enters the maintenance area and is stopped at a first stop position short of the capping position. However, if the carrier is moved further into the maintenance area at a second stop position for capping, the arm causes the maintenance sled to bypass the wiping position when the carrier leaves the second stop position such that a wiping operation is not performed after a capping operation. In this way, wiping can be only performed if the carrier stops at the first stop position. The design utilizes the existing motion of the carrier to control the capping and wiping functions.

Further embodiments contemplate interaction between the maintenance station and the carrier. The maintenance housing defines a hook and a cam. The cam is positioned next to the hook, relative to the direction of travel by the carrier into the maintenance area, and has a profile that extends laterally above the hook. Once the carrier stops at the first stop position, the latch member latches on to the hook to hold the maintenance sled in the wiping position. If the carrier advances to the second stop position, the latch member passes over the cam and, thereafter, is prevented by the profile of the cam from engaging the hook such that the wiping position is bypassed by the maintenance sled after capping.

These and other embodiments are set forth in the description below. Their advantages and features will become readily apparent to skilled artisans. The claims set forth particular limitations.

BRIEF DESCRIPTION OF THE DRAWINGS

The accompanying drawings incorporated in and forming a part of the specification, illustrate several aspects of the present invention, and together with the description serve to explain the principles of the invention. In the drawings.

DETAILED DESCRIPTION OF THE ILLUSTRATED EMBODIMENTS

Figure 1A:
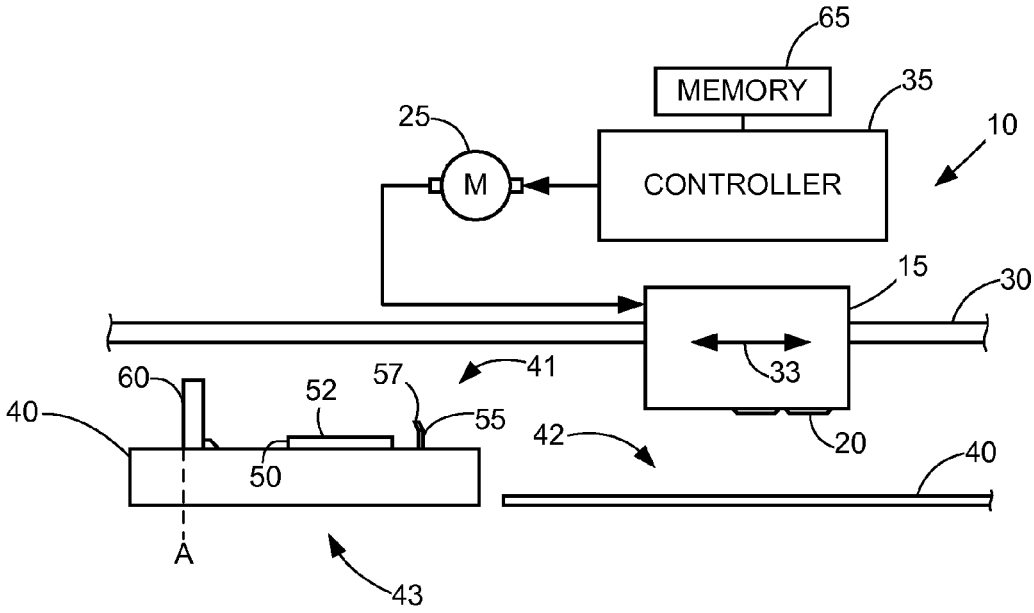
FIGS. 1A-1D are diagrammatic views in accordance with the present invention showing a carrier at different positions relative to a maintenance station.

In the following detailed description, reference is made to the accompanying drawings where like numerals represent like details. The embodiments are described in sufficient detail to enable those skilled in the art to practice the invention. It is to be understood that other embodiments may be utilized and that process, electrical, and mechanical changes, etc., may be made without departing from the scope of the invention. The following detailed description, therefore, is not to be taken in a limiting sense and the scope of the invention is defined only by the appended claims and their equivalents. In accordance with the features of the invention, a maintenance station includes mechanisms that separate a wiping function from a capping function.

With reference to FIGS. 1A-1D, a printhead carrier system 10 for use in an imaging device includes a carrier 15 mounting one or more disposable or (semi) permanent printheads 20. Printheads 20 may have access to a local or a remote supply of ink. Carrier 15 is arranged to be driven by a motor 25 along a shaft 30 that defines a bi-directional scanning path 33. At a directive of a controller 35, motor 25 moves the carrier 15 in a controlled manner along bidirectional scanning path 33. In a printing operation, controller 35 controls the movement of carrier 15 so as to cause the carrier 15 to transport printheads 20 across a sheet of print media 40 in a reciprocating manner along shaft 30 to define an imaging region 42. In order to conduct printhead servicing or maintenance operations, controller 35 controls the movement of carrier 15 to position carrier 15 in relation to a maintenance station 40 located in a non-imaging region 43 of the imaging device.

Maintenance station 40 defines a maintenance area 41 provided for performing printhead maintenance or servicing operations on nozzles of the printheads 20. Such operations may include, for example, a spit maintenance operation, a wiping operation, and a capping operation. Other services, such as for example, priming and suction, may also be performed if desired by the inclusion of a vacuum device of the type well known in the art.

Maintenance station 40 includes a movable maintenance sled 45, a cap 50, and a wiper 55. Maintenance sled 45 includes a carrier engagement member 60 positioned in line of engagement with the carrier 15 and is movable in conjunction with carrier 15 between a wiping position and a capping position. The capping position follows the wiping position along a direction of travel by carrier 15 from the imaging region 42 to the non-imaging region 43 where maintenance station 40 is located.

During use, capping typically occurs less frequently than wiping as capping is usually required only after a printing operation or when printheads 20 are not in use. While printing, printheads 20 may gradually accumulate ink and dust at the nozzles. As such, wiping may have to occur occasionally while printing to remove excess ink and dust at the nozzles. Given that wiping is performed once in a while during printing, arranging the wiping position first and the capping position second, relative to the direction of travel by carrier 15 from the imaging region 42 to non-imaging region 43, advantageously helps save time in printing as carrier 15 would only travel a shorter distance to get back to wiper 55 during a printing operation compared to when the order of the wiping and capping positions are reversed.

FIG. 1A shows maintenance sled 45 prior to carrier 15 entering maintenance area 41. As shown, maintenance sled 45 is in a lowered/rest position at position A. In this position, a top 52 of cap 50 and a top edge 57 of wiper 55 are at heights lower than printheads 20 so that they are clear of printheads 20 when carrier 15 enters maintenance area 41.

Figure 1B:
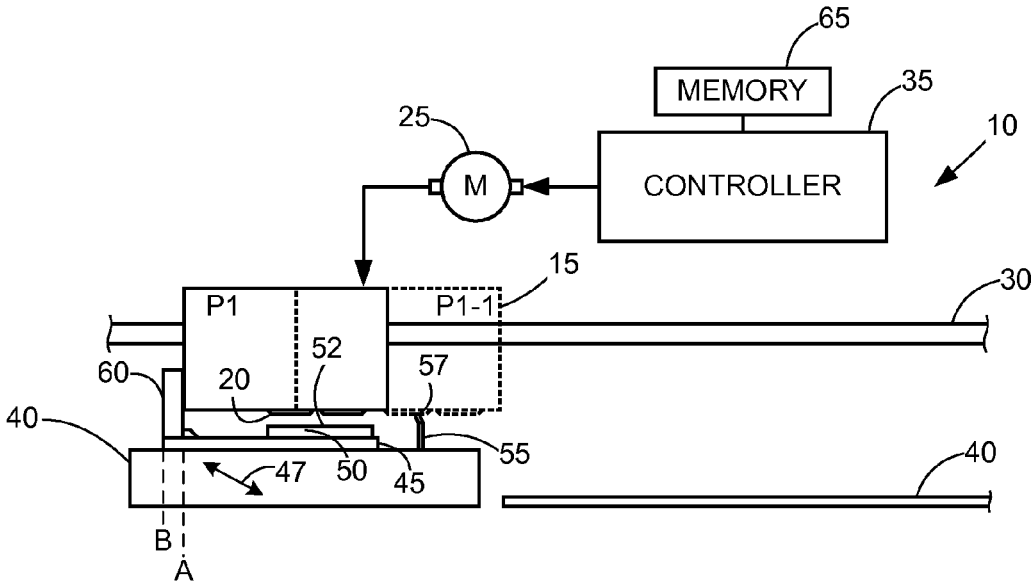

When carrier 15 enters maintenance area 41, carrier 15 passes the wiper 55 and cap 50 and engages carrier engagement member 60 which moves maintenance sled 45 to the left and upward in a diagonal manner, as illustrated by arrow 47 in FIG. 1B, progressing from the lowered/rest position at position A. Meanwhile, movement of maintenance sled 45 also causes wiper 55 to be raised.

FIG. 1B identifies a first carrier position P1 representing a position at which carrier 15 has moved maintenance sled 45 to an intermediate elevation or the wiping position at position B. Once carrier 15 stops at position P1, maintenance sled 45 is locked in the wiping position. As such, position P1 defines a stop position of carrier 15 upon its initial entrance into maintenance area 41 which locks maintenance sled 45 in the wiping position.

In the wiping position, the top edge 57 of wiper 55 is in line of engagement with printheads 20. The top 52 of cap 50, on the other hand, remains below the height of printheads 20 so as to insure that cap 50 remains clear of printheads 20 when maintenance sled 45 is raised in the wiping position. Wiper 55 is thus positioned for wiping printheads 20 while maintenance sled 45 is locked in the wiping position without maintenance sled 45 engaging the capping position. Subsequently after positioning carrier 15 at stop position P1 and after maintenance sled 45 is locked in the wiping position, controller 35 can then move carrier 15 away from carrier engagement member 60 until printheads 20 are positioned over and in engagement with the top edge 57 of wiper 55 as shown by carrier position P1-1 in FIG. 1B. Thereafter, controller 35 moves carrier 15 back and forth along shaft 30 while wiper 55 remains stationary to wipe off particles accumulated on printheads 20. Moving carrier 15 further away from carrier engagement member 60 towards imaging region 42 releases maintenance sled 45 from the wiping position causing maintenance sled 45 to return to its lowered/rest position at position A shown in FIG. 1A.

On the other hand, further advancing carrier 15 into maintenance area 41 past carrier stop position P1 further moves maintenance sled 45 left and upward, progressing from the wiping position at position B.

Figure 1C:
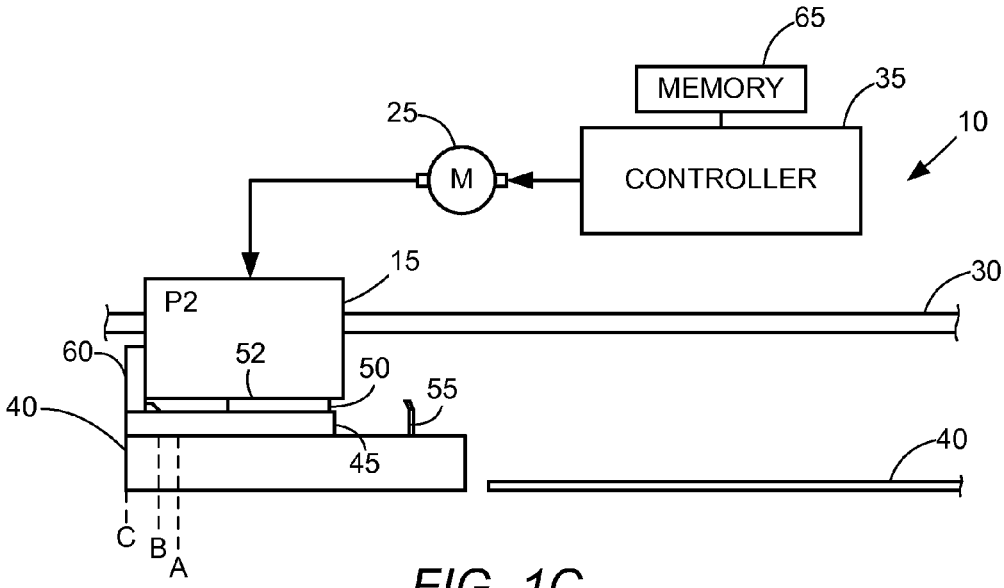

FIG. 1C identifies a second carrier position P2 representing a position at which carrier 15 has fully raised maintenance sled 45 to the capping position at position C. Once carrier 15 stops at position P2, maintenance sled 45 is held by carrier 15 in the capping position via carrier engagement member 60. In the capping position, top 52 of cap 50 progresses above the top edge 57 of wiper 55 such that top 52 engages carrier 15 and cap 50 encloses printheads 20.

Figure 1D:
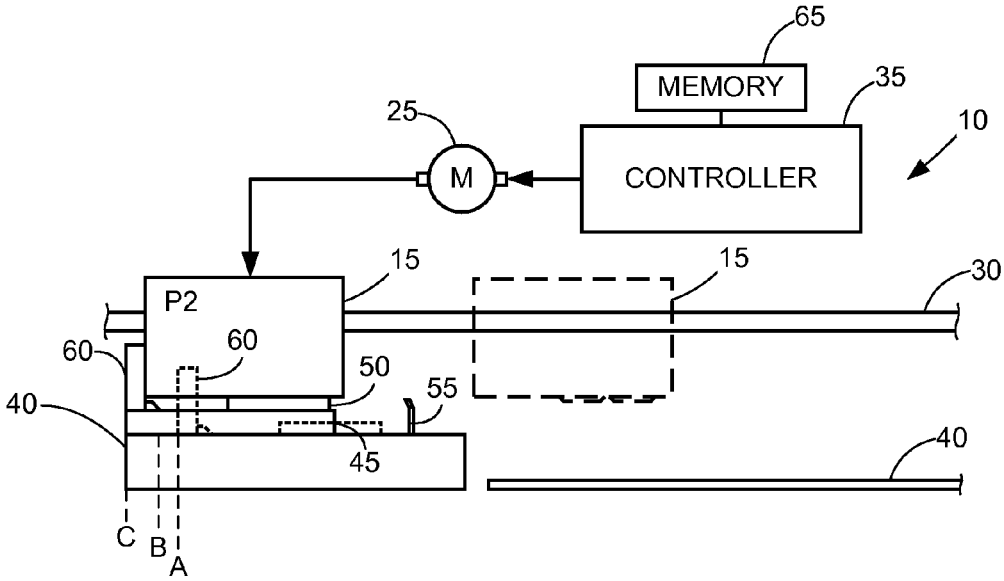

When carrier 15 is controlled by controller 35 to leave position P2, maintenance sled 45 follows carrier 15 until it returns to its lowered/rest position at position A without getting locked in the wiping position at position B during its travel, as shown in FIG. 1D. Thus, maintenance sled 45 bypasses the wiping position and directly returns to its lowered/rest position at position A after a capping operation at position C. Position P2 therefore defines a stop position of carrier 15 which allows a capping function to be performed without a wiping function thereafter.

With the above features, wiping and capping functions can occur independently of one another during a servicing operation. In this way, excessive wiping associated with the capping function is avoided such that the life of a printhead may be preserved.

A servicing algorithm may be executed by controller 35 to determine if printheads 20 need servicing, and whether or not wiping is required at the particular instance of performing the servicing operation. In an example embodiment, controller 35 has access to a memory 65 which stores printhead-related data and/or parameters that it can use to control the servicing operation. For example, controller 35 may utilize timetables, printhead-related data such as the number of pages printed, drops fired, and/or wipes performed on the printhead, and/or other parameters related to printhead operation that are stored/recorded within memory 65 to determine whether to wipe printheads 20 during the servicing or not.

Depending on the result of the determination performed by controller 35 using the servicing algorithm, controller 35 controls carrier 15 to stop at either one of positions P1 and P2 as carrier 15 initially enters maintenance station 40 for a servicing operation. A positive determination that wiping is required for the servicing operation causes controller 35 to position carrier 15 at the first stop position P1. If it is determined that wiping is not required, controller 35 positions carrier 15 at the second stop position P2. As a result, a wiping function can be done without a capping function by positioning carrier 15 at stop position P1 short of the capping position, and a capping function can be done without a wiping function by positioning carrier 15 at stop position P2 during a particular instance of performing a servicing procedure.

Figure 2:
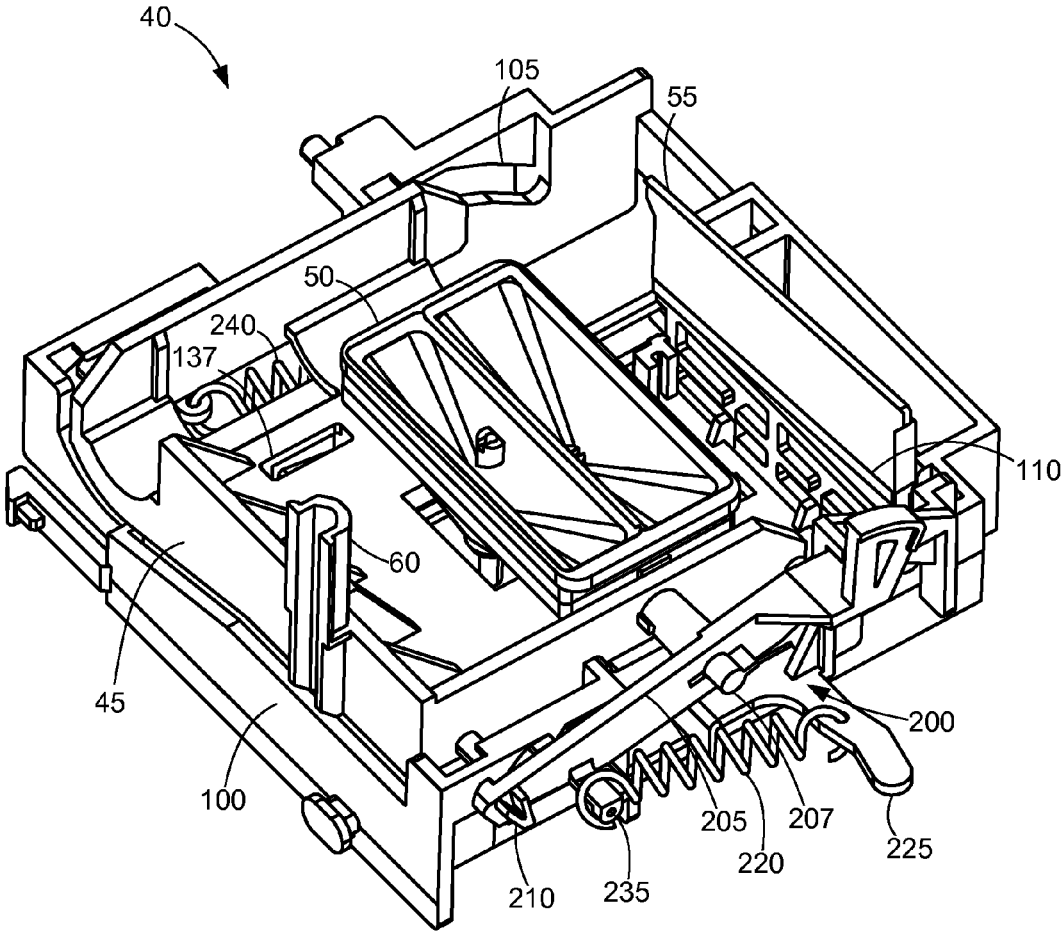
FIG. 2 is a perspective view of the maintenance station shown in FIGS. 1A-1D.
Figure 3:
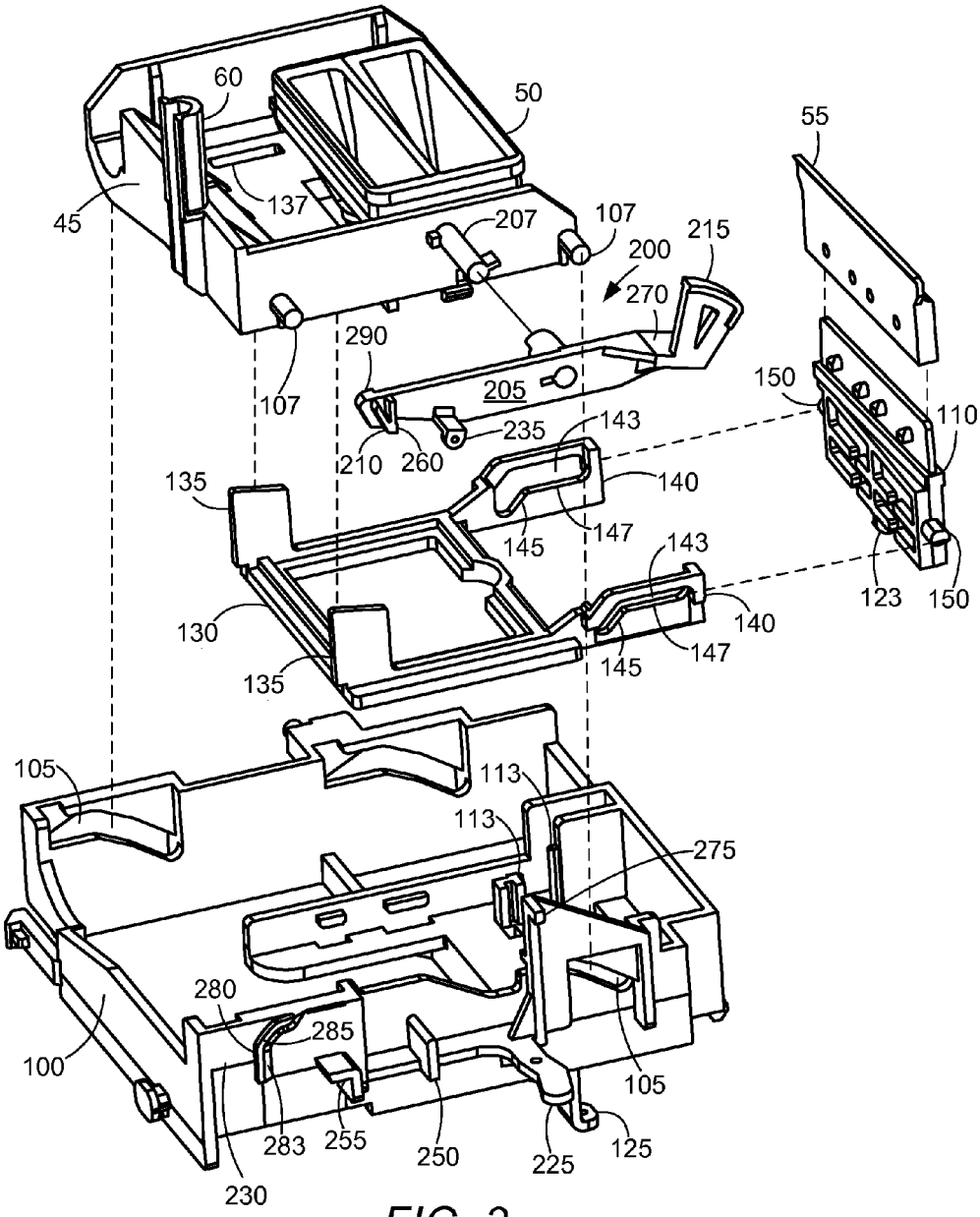
FIG. 3 is an exploded view of the maintenance station shown in FIG. 2.

With reference to FIGS. 2-6, the interaction of carrier 15 with maintenance sled 45 of maintenance station 40 will now be described in more detail. As shown in FIGS. 2 and 3, maintenance station 40 includes a housing 100 that supports movable maintenance sled 45. Housing 100 surrounds maintenance sled 45 and includes guide slots 105 for receiving corresponding guide pins 107 of maintenance sled 45. Each guide pin 107 is positioned to slidably travel in a corresponding one of the guide slots 105. Thus, maintenance sled 45 is movably mounted to housing 100 via the interaction between guide slots 105 and guide pins 107. Maintenance sled 45 is continuously biased by a return spring 240 in a direction toward its rest/lowered position such that maintenance sled 45 returns to position A when carrier 15 moves out of maintenance area 41. Maintenance station 40 also includes printhead caps 50 mounted on maintenance sled 45, and wiper 55 operatively coupled to the maintenance sled 45.

Wiper 55 may be formed of an elastomer such as a thermoplastic polyurethane material. Wiper 55 is mounted on a wiper holder 110 that is arranged to fit between vertical restricting members 113 in housing 100 in such a manner that limits the movement of wiper holder 110 in the vertical direction. A spring 120 (FIG. 4) continuously urges the wiper holder 110 downward so as to clear wiper 55 of carrier 15 and printheads 20 when carrier 15 moves out of the maintenance area 41. One end of the spring 120 is connected to a bottom end 123 of the wiper holder 110 and the other end of spring 120 is connected to a stationary hook 125 extending downwardly from a bottom surface 127 of housing 100. A sliding frame 130 is sandwiched between maintenance sled 45 and the bottom surface 127 of housing 100. Sliding frame 130 operatively couples the wiper holder 110 to the maintenance sled 45 by means of projections 135 protruding upwardly from sliding frame 130 and a pair of extended arms 140 extending from sliding frame 130 towards wiper holder 110. Projections 135 pass through apertures 137 formed on the bottom surface of maintenance sled 45 while extended arms 140 each have slots 143 having ramped sections 145 and upper dwell sections 147 configured to receive opposed guide members 150 of wiper holder 110. When sliding frame 130 moves in a horizontal direction as a consequence of its contact with the maintenance sled 45 via projections 135, opposed guide members 150 of wiper holder 110 slidably travel along the slots 143 between ramped sections 145 and upper dwell sections 147 causing wiper holder 110 and wiper 55 to move in the vertical direction. As a result, diagonal movement of the maintenance sled 45 causes the wiper 55 to also move substantially vertically. Spring 120 contracts and stretches as opposed guide members 150 are located in the lower ends of ramped sections 145 and in the upper dwell sections 147, respectively. When opposed guide members 150 rest on the lower ends of ramped sections 145, wiper 55 is in a lowered position. When opposed guide members 150 rest on top of the upper dwell sections 147, wiper 55 is raised to be in line of engagement with printheads 20.

With further reference to FIGS. 2 and 3, maintenance station 40 includes a sled latch mechanism 200 for locking maintenance sled 45 in the wiping position. Sled latch mechanism 200 includes a latch arm 205 pivotably mounted to the maintenance sled 45 about a pivot axis 207. The latch arm 205 includes a latch member 210 at one end and a release member 215 at an opposite end thereof. The latch arm 205 is continuously urged to rotate counter-clockwise by a biasing spring 220 disposed at an angle to the direction of longitudinal movement of the maintenance sled 45. One end of the biasing spring 220 is attached to an arm 225 extending from a front wall 230 of housing 100. The other end of biasing spring 220 is connected to a pin 235 formed as a unitary piece with latch arm 205 located adjacent latch member 210. Accordingly, one component of the force exerted by the biasing spring 220 continuously urges latch member 210 of latch arm 205 to rotate downward to engage features located in the front wall 230 of housing 100, as will be explained in greater detail below, while another component of the force of biasing spring 220 aids return spring 240 in urging maintenance sled 40 back to its lowered/rest position at position A when carrier 15 moves out of maintenance area 41. The spring force exerted by biasing spring 220 together with the spring force of return spring 240 must be sufficient to accelerate maintenance sled 45 and its associated components to the lowered position so that they are clear of carrier 15 and printheads 20 as carrier 15 moves out of the maintenance area 41 and returns to the imaging region 42 for printing.

Figure 4:
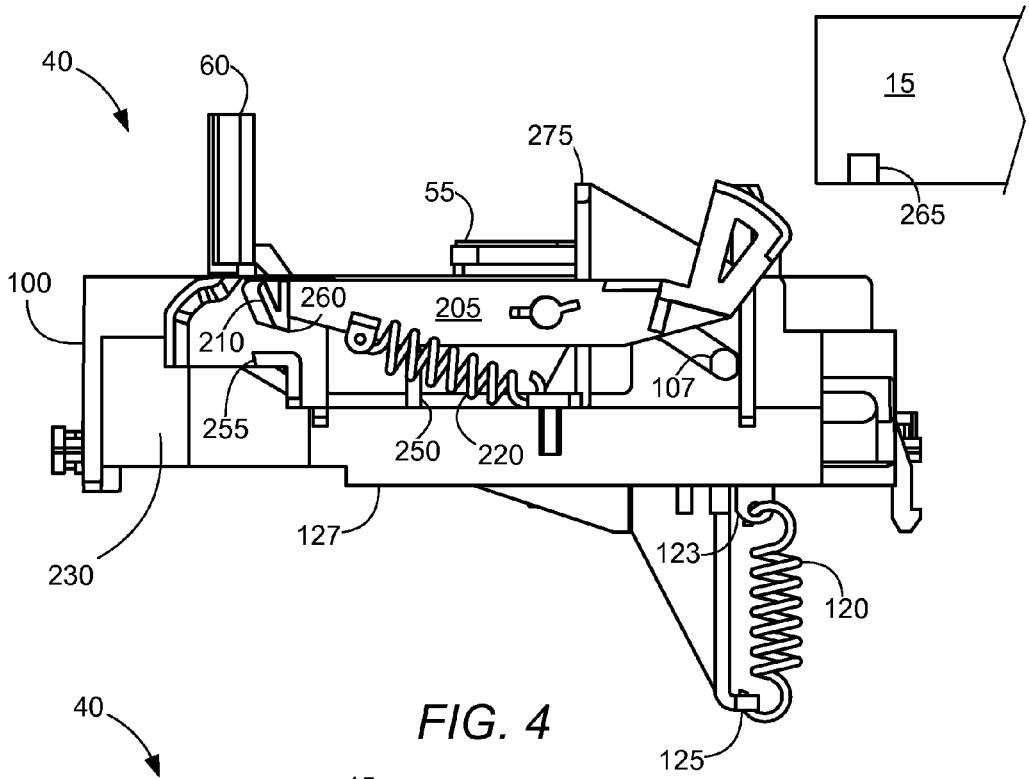
FIG. 4 is a side view illustrating the maintenance station in FIG. 2 when the carrier is at a position shown in FIG. 1A.

In accordance with embodiments of the present disclosure, the sled latch mechanism 200 is configured to selectively lock the maintenance sled 45 in the wiping position without engaging the capping position based on a position where carrier 15 stops upon initial entrance into the maintenance station 40 for a maintenance operation. FIG. 4 shows the maintenance station 40 prior to carrier 15 engaging carrier engagement member 60 of maintenance sled 45. As shown, latch arm 205 of latch mechanism 200 initially rests on top of a support member 250 extending from the front wall 230 of housing 100 such that latch member 210 is positioned directly above a hook feature 255 defined on the front wall 230 of housing 100. As carrier 15 enters maintenance station 40 and engages carrier engagement member 60, maintenance sled 45 moves diagonally upward, as illustrated by arrow 47 in FIG. 1B, dragging along sliding frame 130 beneath it in the horizontal direction due to projections 135 being caught in apertures 137 of maintenance sled 45. Movement of maintenance sled 45 also causes latch arm 205 to rotate about pivot axis 207 in a counter-clockwise direction due to the biasing force provided by biasing spring 220. As carrier 15 moves further into the maintenance station 40, latch member 210 is brought closer to hook feature 255 by biasing spring 220. At the same time, opposed guide members 150 of wiper holder 110 rides up from the lower ends of the ramped sections 145 to the upper dwell sections 147 of slots 143 against the biasing force of spring 120 thereby raising wiper 55.

Figure 5:
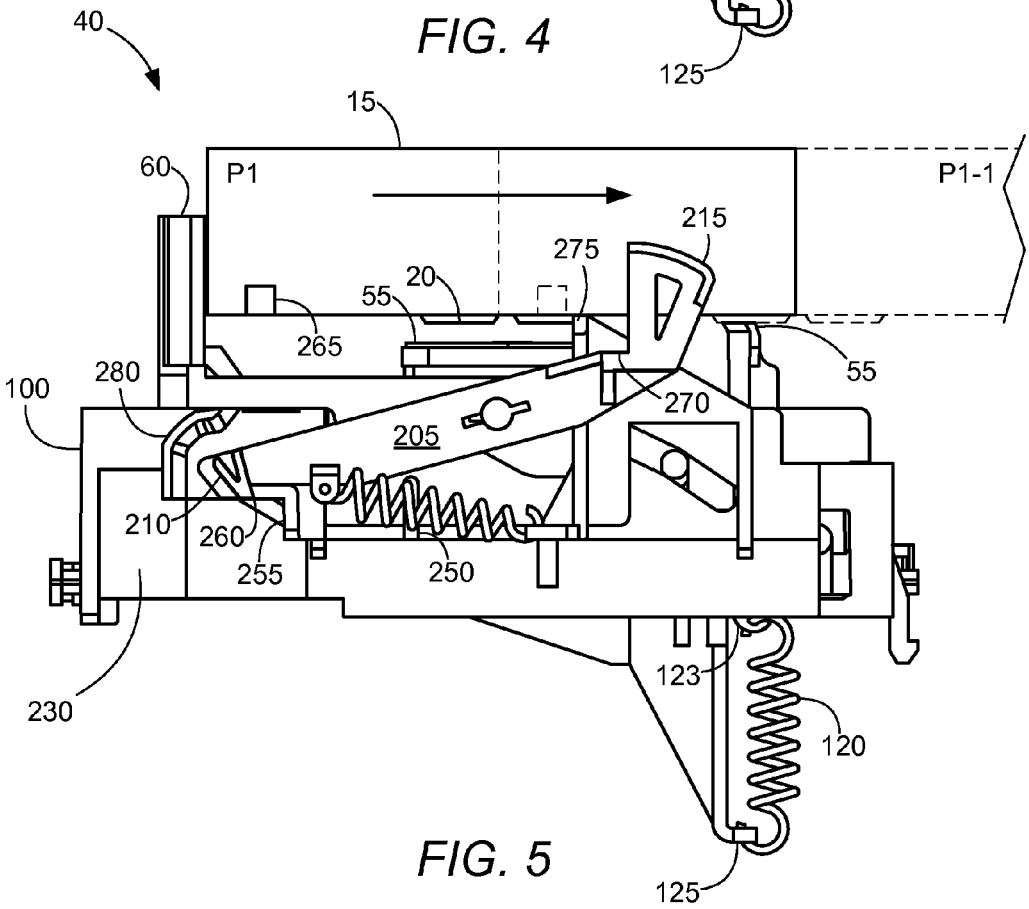
FIG. 5 is a side view illustrating the maintenance station in FIG. 2 when the carrier is at a position shown in FIG. 1B.
Figure 6:
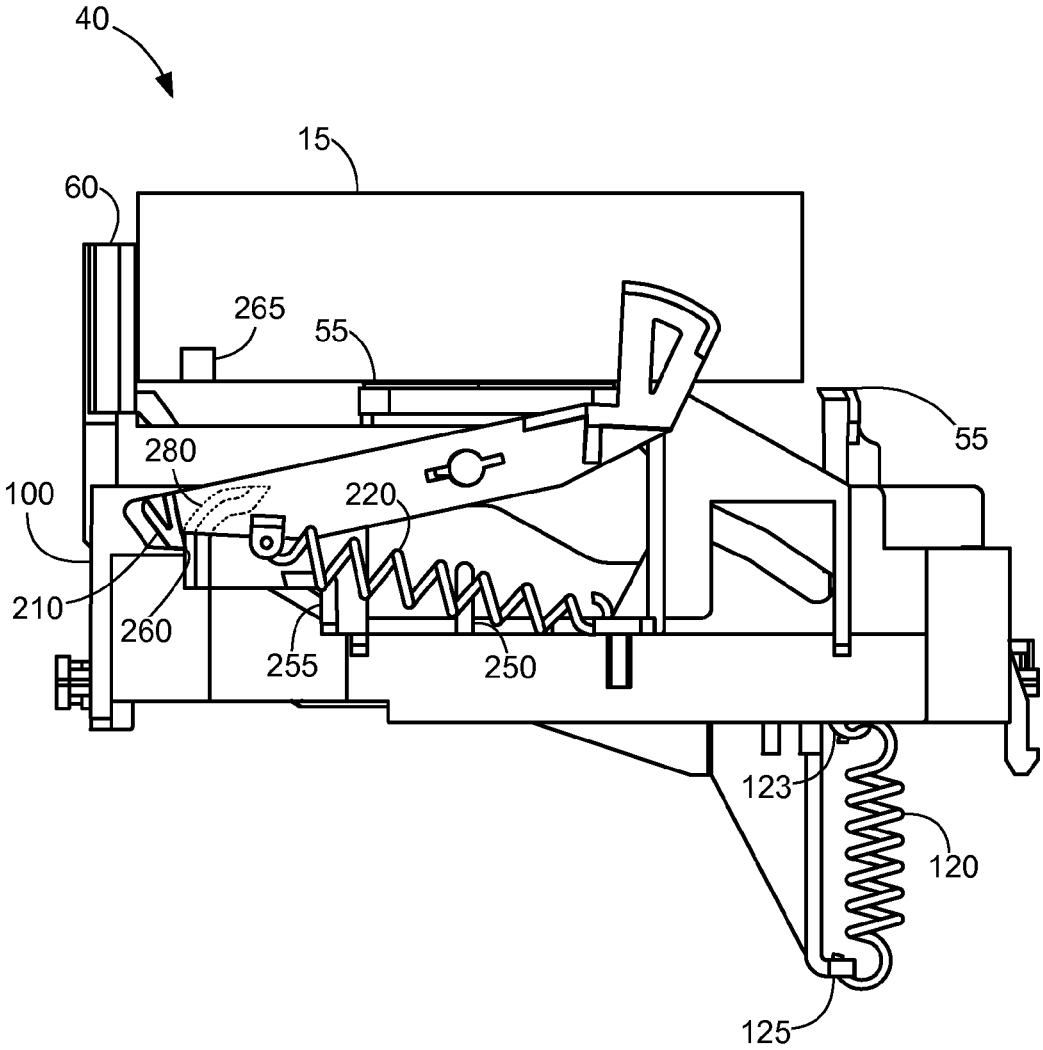
FIG. 6 is a side view illustrating the maintenance station in FIG. 2 when the carrier is at a position shown in FIG. 1C.

If carrier 15 is stopped immediately after a first nose portion 260 of latch member 210 passes over and latches on to hook feature 255 (position corresponding to the first stop position P1 of carrier 15 in FIG. 1B), latch arm 205 in conjunction with hook feature 255 holds maintenance sled 45 to remain in the wiping position even if carrier 15 disengages from carrier engagement member 60, as shown in FIG. 5. Meanwhile, wiper 55 is also maintained in the raised position. As a result, carrier 15 is free to move a predetermined distance away from carrier engagement member 60 at position P1-1 without maintenance sled 45 being disengaged in the wiping position so as to cause nozzles of printheads 20 to be wiped by wiper 55. In one example, carrier 15 may consequently move back and forth along shaft 30 to cause printheads 20 to be wiped by wiper 55 bi-directionally. The back and forth movement of carrier 15 during wiping is set such that release tab 265 on carrier 15 does not engage release member 215.

After wiping is completed, carrier 15 may return to the imaging region 42 for a printing operation. In such case, carrier 15 is moved a distance greater than the predetermined distance towards the imaging region 42 so as to cause release tab 265 to engage release member 215. Upon engagement, latch arm 205 of the sled latch mechanism 200 pivots clockwise about pivot axis 207 against the force of biasing spring 220 to remove first nose portion 260 of latch member 210 from engagement with hook feature 255. The release of latch member 210 enables biasing spring 220 and return spring 240 to move maintenance sled 45 back to its lowered/rest position as carrier 15 leaves maintenance station 40. At the same time, sliding frame 130 is dragged along by maintenance sled 45 due to projections 135 being caught in apertures 137 causing opposed guide members 150 of wiper holder 110 to ride down from the upper dwell sections 147 to the lower ends of ramped sections 145 of slots 143 on sliding frame 130 with the help of spring 120 thereby lowering wiper 55.

However, if wiping is not required for the maintenance procedure, carrier 15 is moved further into maintenance station 40 after first nose portion 260 passes over hook feature 255 until carrier 15 reaches a position corresponding to the carrier stop position P2 in FIG. 1C where maintenance sled 45 is also raised in the capping position. In the capping position shown in FIG. 6, cap 50 is held in sealing relation with the printheads 20. In the course of carrier 15 moving further towards the capping position (FIG. 6) after maintenance sled 45 reaches the wiping position or after first nose portion 260 passes over hook feature 255 (FIG. 5), a flat surface 270 at the base of release member 215 is biased against a stop member 275 extending from the front wall 230 of housing 100. Stop member 275 restricts counter-clockwise rotation of latch arm 205 and causes latch arm 205 to rotate in an opposite (clockwise) direction such that before maintenance sled 45 reaches the capping position, latch member 210 is rotated upwardly allowing it to pass and move over to the other side of a cam feature 280 located next to hook feature 255 relative to the motion of maintenance sled 45 as it approaches the capping position.

Cam feature 280 is formed on the front wall 230 of housing 100. In one embodiment, cam feature 280 may include a curved profile that extends laterally above hook feature 255, as shown in FIGS. 2-6. The profile of cam feature 280 includes a ramped surface 283 and a transition portion 285 (FIG. 3). Transition portion 285 defines a boundary in which maintenance sled 45 can no longer be locked in the wiping position even if carrier 15 stops short of the capping position. More particularly, once a second nose portion 290 generally protruding from the rear of latch member 210 slides over the ramped surface 283 and moves past the transition portion 285 as maintenance sled 45 is moved further towards the capping position, first nose portion 260 can no longer engage hook feature 255 to hold maintenance sled 45 in the wiping position when carrier 15 disengages from the carrier engagement member 60. In other words, maintenance sled 45 will only be locked in the wiping position if second nose portion 290 is arranged between hook feature 255 and transition portion 285 of cam feature 280.

When carrier 15 is controlled to move out of maintenance station 40 after capping, biasing forces provided by biasing spring 220 and return spring 240 urges maintenance sled 45 to follow with the motion of carrier 15. Second nose portion 290 travels along the profile of cam feature 280 (FIG. 6) causing the first nose portion 260 of the latch member 210 to move above and bypass hook feature 255 as maintenance sled 45 decreases elevation. Accordingly, maintenance sled 45 is prevented from being locked in the wiping position during its travel from the capping position to its rest position. Sliding frame 130 also moves in a horizontal direction as a consequence of its contact with the maintenance sled 45 while opposed guide members 150 of wiper holder 110 slidably travel along the slots 143 from upper dwell sections 147 to the lower ends of ramped sections 145 thereby lowering the wiper holder 110 and the wiper 55 as carrier 15 moves out of maintenance station 40.

In other alternative embodiments, cam feature 280 may have other designs, profiles, shapes, forms, or structures. For example, cam feature 280 may comprise a track (not shown) that is heat staked on housing 100 with steel adding features (not shown). Regardless of the design, cam feature 280 functions to cause latch member 210 to bypass hook feature 255 when maintenance sled 45 is pulled back by spring forces to its rest position as carrier 15 moves out of maintenance station 40 after a capping operation. In this way, wiping is bypassed after capping. It is also contemplated that although the invention allows wiping to be performed without capping, printheads 20 may optionally advance for a capping operation after a wiping operation, if desired. In other words, maintenance sled 45 may immediately return back from the wiping position to its rest position or proceed to the capping position, both depending on the direction of movement of carrier 15 after the maintenance sled is locked in the wiping position.

Relatively apparent advantages of the many embodiments include, but are not limited to, providing an asynchronous wiping mechanism where a wiping function is not performed after a capping function, and providing a means to effectively control wiping function without a need for additional drive mechanisms to control asynchronous capping and wiping functions. Advantages also introduce notions of performing a wiping operation based on a position where a carrier stops as it enters a maintenance station. More particularly, wiping is performed if a carrier stops short of a capping position, and bypassed if the carrier moves the maintenance sled all the way into the capping position upon initial entrance into a maintenance station.

The foregoing illustrates various aspects of the invention. It is not intended to be exhaustive. Rather, it is chosen to provide the best illustration of the principles of the invention and its practical application to enable one of ordinary skill in the art to utilize the invention, including its various modifications that naturally follow. All modifications and variations are contemplated within the scope of the invention as determined by the appended claims. Relatively apparent modifications include combining one or more features of various embodiments with features of other embodiments.

The invention claimed is:

1. A maintenance station for servicing a printhead mounted on a carrier that is movable between an imaging region and a non-imaging region adjacent a maintenance area, comprising:

a maintenance housing defining the maintenance area;

a maintenance sled mounted to the maintenance housing and movable in conjunction with the carrier between a wiping position and a capping position, the capping position following the wiping position along a direction of travel by the carrier from the imaging region to the non-imaging region; and a latch pivotably mounted to the maintenance sled for selectively locking the maintenance sled at the wiping position without engaging the capping position based on a stop position of the carrier upon initial entrance into the maintenance area.

2. The maintenance station of claim 1, wherein the latch locks the maintenance sled in the wiping position when the stop position of the carrier is short of the capping position, relative to the direction of travel by the carrier.

3. The maintenance station of claim 1, wherein the latch does not lock the maintenance sled in the wiping position when the stop position of the carrier is directly above the capping position, and wherein when the carrier leaves the first stop position, the maintenance sled does not engage the wiping position such that the printhead is not wiped as the carrier moves out of the maintenance area after the capping operation.

4. The maintenance station of claim 1, further comprising a carrier engagement member extending upwardly from the maintenance sled and a hook disposed on a side of the maintenance housing directly below a head of the latch, wherein a pivotal movement of the latch due to the carrier entering the maintenance area and engaging the carrier engagement member causes the head to engage the hook and lock the maintenance sled in the wiping position when the carrier stops after the head passes over the hook.

5. The maintenance station of claim 4, further comprising a cam disposed on the side of maintenance housing next to the hook relative to the direction of travel by the carrier and having a profile extending laterally above the hook such that the latch slides against the profile of the cam to bypass the hook and not lock the maintenance sled in the wiping position when the maintenance sled leaves the capping position.

6. The maintenance station of claim 5, wherein the hook and the cam define limits of a range of positions for the head to be positioned and still hold the maintenance sled in the wiping position.

7. The maintenance station of claim 1, further comprising a vertically movable wiper holder mounted to the maintenance housing and operatively coupled to the maintenance sled via a sliding frame, the sliding frame connected to the maintenance sled at one end thereof and to the wiper holder at an opposite end thereof such that an uphill or downhill movement of the maintenance sled moves the sliding frame in a horizontal direction to thereby move the wiper holder in a vertical direction.

8. The maintenance station of claim 7, wherein the wiper holder includes opposed guide members inserted through slots having ramped and upper dwell portions formed on opposite sides of the sliding frame, the opposed guide members resting on lower ends of the ramped portions when the wiper holder is in a lowered position and on the upper dwells when the wiper holder is in a raised position.

9. A maintenance station for servicing a printhead mounted on a carrier that is movable between an imaging region and a non-imaging region adjacent a maintenance area, comprising:

a maintenance housing defining the maintenance area;

a maintenance sled mounted to the maintenance housing and movable in conjunction with the carrier between a wiping position and a capping position, the capping position following the wiping position along a direction of travel by the carrier from the imaging region to the non-imaging region; and an arm pivotably mounted to the maintenance sled and operative to cause the maintenance sled to bypass the wiping position upon leaving the capping position such that a wiping operation is not performed as the carrier moves from the maintenance area after a capping operation.

10. The maintenance station of claim 9, wherein the maintenance housing includes a hook disposed on a side thereof, the arm including a first nose portion protruding at a first end thereof for selectively engaging the hook to lock the maintenance sled in the wiping position based on a stop position of the carrier upon initial entrance into the maintenance area.

11. The maintenance station of claim 10, wherein the first nose portion locks the maintenance sled in the wiping position when the stop position of the carrier stops is short of the capping position, relative to the direction of travel by the carrier from the imaging region to the non-imaging region.

12. The maintenance station of claim 10, wherein the maintenance housing further includes a cam disposed on the side thereof next to the hook relative to the direction of travel by the carrier, the cam having a profile extending laterally above the hook such that as the maintenance sled leaves the capping position, the first nose portion moves along the profile of the cam to bypass the hook and not lock the maintenance sled in the wiping position.

13. The maintenance station of claim 12, wherein the arm further includes a second nose portion protruding at the first end in an opposite direction with respect to the first nose portion, the second nose portion configured to slide against the profile of the cam to keep the first nose portion from engaging the hook when the maintenance sled leaves the capping position.

14. The maintenance station of claim 12, wherein the hook and the cam define limits of a range of positions for the first nose portion to be positioned and still lock the maintenance sled in the wiping position.

15. The maintenance station of claim 10, wherein the arm further includes a release member extending at a second end thereof positioned for engagement with the carrier when the maintenance sled is locked in the wiping position, the arm configured to pivot upon actuation of the release member by the carrier to remove the first nose portion from engagement with the hook and release the maintenance sled from the wiping position.

16. The maintenance station of claim 15, wherein the maintenance housing further includes a stop member extending from the side thereof and positioned above the second end of the arm to restrict an upward rotation of the release member and to correspondingly cause the first nose portion to rotate upwardly away from the hook when the maintenance sled is moved by the carrier to the capping position.

* * * * *